United States Patent [19]

Stromberg et al.

[11] Patent Number: 4,944,842

[45] Date of Patent: Jul. 31, 1990

[54] METHOD FOR REDUCING CONTAMINATION IN PULP PROCESSING

[75] Inventors: C. Bertil Stromberg; Joseph R. Phillips; Louis O. Torregrossa, all of Glens Falls, N.Y.

[73] Assignee: Kamyr, Inc., Glen Falls, N.Y.

[21] Appl. No.: 40,245

[22] Filed: Mar. 26, 1987

[51] Int. Cl.[5] ..... D21C 9/02; D21C 9/10; D21F 1/66

[52] U.S. Cl. ..... 162/60; 162/88; 162/190

[58] Field of Search ..... 162/47, 29, 60, 88, 162/89, 40, 190, 239, 241, 290, 264

[56] References Cited

U.S. PATENT DOCUMENTS

| | | | |
|---|---|---|---|
| 2,057,059 | 10/1936 | Rue | 162/190 |
| 3,698,995 | 10/1972 | Rupson | 162/89 |
| 3,884,752 | 5/1975 | Campbell et al. | 162/88 |
| 3,919,041 | 11/1975 | Wilder | 162/89 |
| 4,529,479 | 7/1985 | Tuomi | 162/60 |
| 4,705,600 | 11/1987 | Jacobsen | 162/19 |

*Primary Examiner*—Steve Alvo

*Attorney, Agent, or Firm*—Nixon & Vanderhye

[57] ABSTRACT

Method and apparatus for reducing contamination in processed pulp and in white water effluent discharged from a pulp dryer or paper making mill. The system includes multiple pulp bleaching and washing stages wherein white water effluent discharge from the dryer or paper making mill is fed to the next-to-last washing stage and fresh water is supplied to the last washing stage.

20 Claims, 2 Drawing Sheets

METHOD FOR REDUCING CONTAMINATION IN PULP PROCESSING

BACKGROUND

This invention relates generally to pulp processing and, more particularly, to the final bleaching and washing stages of a multiple stage pulp processing system.

In the pulping industry, environmental and economic concerns dictate that water be conserved and effluent volumes be reduced. Reductions in the amount of fresh water consumed, as well as in effluent volumes may have additional beneficial consequences in the form of reductions in amounts of fibers and chemicals used, reductions in heat losses, and overall reductions in operating costs. To achieve these benefits, however, it is critical that these matters be handled correctly and efficiently.

One area of conventional pulp processing which utilizes considerable amounts of fresh water is in the washing operations following the last two pulp bleaching stages. Another area where large amounts of fresh water are used is in pulp drying apparatus.

In the prior art, one current practice is to conserve water by extensive recycling in the pulp dryer, and by using excess white water effluent discharge from the dryer to wash pulp in the washer following the last bleaching stage. In this manner, effluent from the pulp dryer can be substantially reduced. However, fresh water is still required in the next-to-last washer accompanying the next-to-last bleaching stage. The prior art arrangement described above causes corrosion problems in the dryer due to the build up of salt, pitch and resin concentrations which will eventually effect pulp quality. In addition, this configuration can result in build up of other potentially harmful substances that could cause injury to intermediate or final users of the product.

It has now been discovered that the problem of build up of various harmful deposits in the white water system of the pulp dryer (or other pulp processing apparatus such as a paper making mill), may be effectively dealt with by using the white water effluent discharge as the wash water in the second-to-last washer stage, and by using fresh water in the last washer stage. In this way, most of the harmful white water compounds will be washed out in the last washer. As a result, it has been found that fresh water consumption and effluent volumes may be maintained at a lower level, and contamination of the white water discharge as well as the pulp leaving the dryer or other processing apparatus may be reduced up to about 40% of the contamination level currently experienced in the prior art systems.

Another advantage of the arrangement described herein is a reduction in corrosion within the pulp dryer which, normally, is not made of the higher grade alloys used in the construction of, for example, the pulp bleaching apparatus.

While there may be other ways to reduce the concentrations of various harmful compounds in the white water system, the only one that has been found to have reduced water consumption and effluent volume is one which requires the addition of still another washer stage between the last bleaching stage and the pulp dryer or other pulp processing equipment. However, the cost of this measure is substantially higher, both from an investment standpoint as well as an operational standpoint, particularly since this additional washer would have to be made of high grade steels to prevent excess corrosion.

Additional details and objects of the invention will become apparent from the detailed description of the invention and claims which follow.

DETAILED DESCRIPTION OF THE INVENTION

Figure 1:
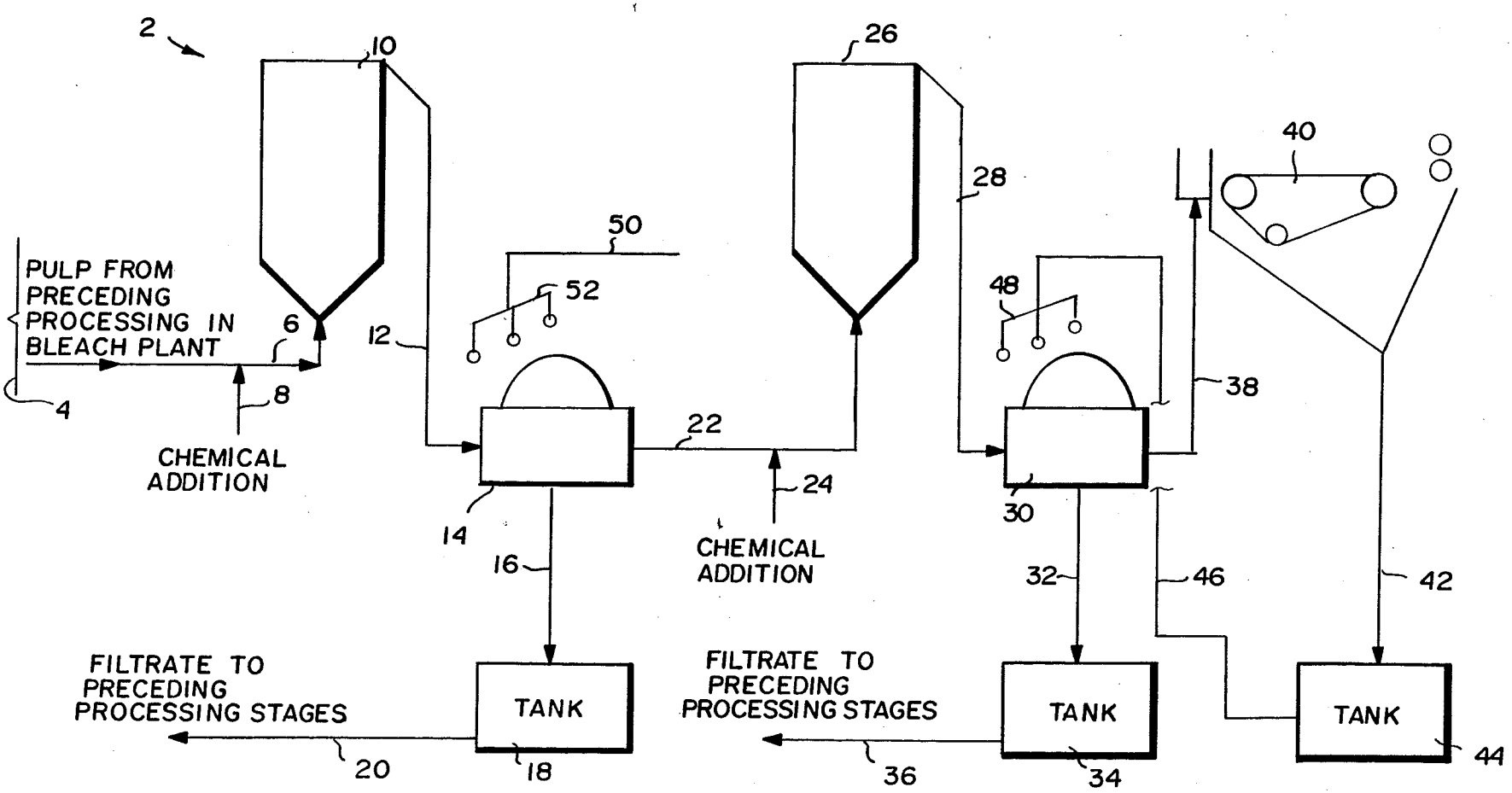
FIG. 1 PRIOR ART
FIG. 1 represents a schematic diagram of the final bleaching and washing stages of a pulp processing system typically utilized in the prior art.

Referring now to FIG. 1, the final stages of a multiple stage pulp processing system 2 are shown in schematic form. Pulp from a preceding processing stage 4 is pumped through a conduit 6 and, after mixing with chemical additives at 8 is fed into a bleaching tower 10. The bleaching tower 10 represents the next-to-last bleaching stage in the process. From the tower 10, the pulp flows through conduit 12 to a washer stage 14, representing the next-to-last washer stage. Discharge from the washer 14 flows by way of conduit 16 through a filtrate tank 18 from which it is recycled to preceding process stages via conduit 20.

Pulp is fed from the washer stage 14 through conduit 22 which receives further chemical additives at 24 prior to entering the last bleaching tower 26. The finally bleached pulp is then passed by way of conduit 28 to a final washer stage 30. Washer discharge flows through line 32 to a filtrate tank 34 from which the filtrate is recycled to preceding processing stages through conduit 36. The finally washed pulp is then transported through a conduit 38 to a further pulp processing device 40 which could be, for example, a pulp dryer, paper making mill or the like. White water effluent discharge flows from the pulp dryer, paper making mill or the like, through a discharge conduit 42 to a white water holding tank 44. It is conventional in the prior art to feed the white water from tank 44 through a conduit 46 to the last washing stage 30 where it is dispensed through nozzles 48. Utilization of white water in the last washer stage 30 is said to substantially eliminate effluent from the pulp dryer, paper mill or other pulp processing device.

In this prior art system, fresh water alone, or fresh water mixed with filtrate from the last washer stage, or fresh water with minor amounts of white water from the white water holding tank 44 are utilized in conjunction with the next-to-last washer stage. Specifically, the water or water mixture is added by way of conduit 50 to dispensing nozzles 52 associated with washer stage 14.

As previously stated, the above described prior art arrangement eventually leads to corrosion problems in the dryer or other pulp processing apparatus due primarily to the build up of salt, pitch, and resin concentrations that eventually effect the quality of the final pulp product. Build up of other substances which are potentially harmful to users of the end product may also occur.

Figure 2:
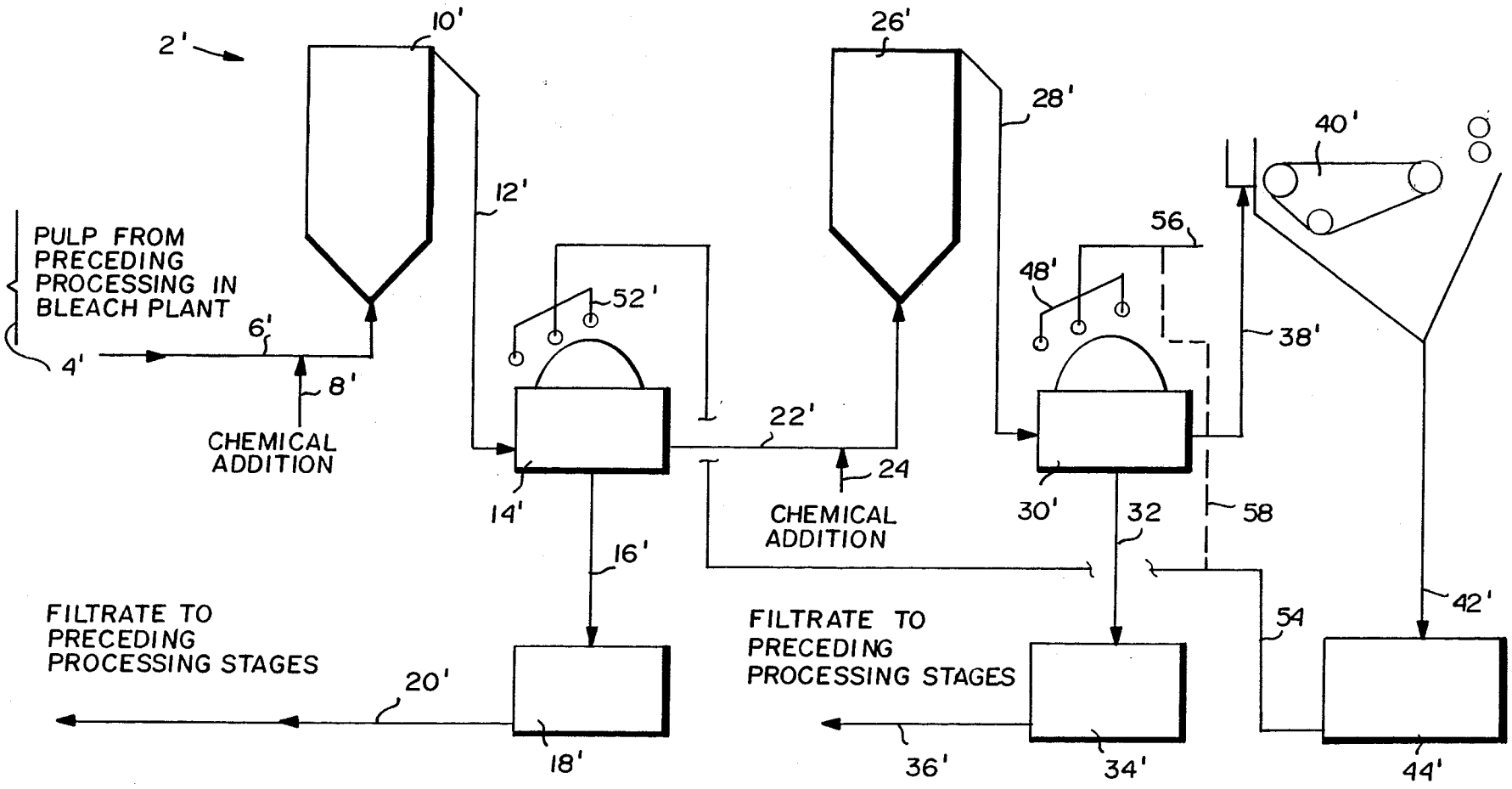
FIG. 2 represents a schematic diagram of the final bleaching and washing stages of a pulp processing system in accordance with this invention.

Turning now to FIG. 2, illustrated therein is a schematic diagram of a contamination reduction system in accordance with the present invention.

Like numerals, with prime characters added, are utilized to refer to elements in common with the prior art system illustrated in FIG. 1. Thus, pulp from a previous processing stage 4' in the bleaching plant is transported through conduit or pipe 6', to which chemical additives are supplied at 8', and fed through the bleaching tower 10' to a washer stage 14'.

Pulp leaving washer stage 14' is then passed, via line 22', to the final bleaching tower 26', and thereafter, through conduit 28' to the final washer stage 30'. While the washers are illustrated as outside the towers, they may be within the towers (e.g. diffusion washers). Subsequently, the pulp is delivered via conduit 38' to a pulp dryer, or paper making machine, or the like 40'. As in the prior art system, discharge from next-to-last washer 14' is passed through a filtrate tank 18' and the filtrate is returned to preceding processing stages via conduit 20'. Similarly, discharge from the last washer 30' is passed through a filtrate tank at 34' and returned via line 36' to preceding processing stages. It will be understood, of course, that line 36' may be operatively connected to the next-to-last washer stage 14'. It is at this point that the present invention departs from the prior art arrangement.

In accordance with an exemplary embodiment of this invention, white water effluent discharge from the holding tank 44' is transported through a conduit 54 to the dispensing unit 52' at the next-to-last washer stage 14'. It will be appreciated that the white water may be utilized in the washer stage 14' alone or in combination with filtrate from the last washer stage 30'.

At the same time, fresh water, or fresh water with minor amounts of white water from the holding tank 44 (represented by phantom conduit 58), is fed via conduit 56 to the dispensing unit 48' at the last washer stage 30'.

By using the white water as wash water in the next-to-last washer stage 14', it has been found that most of the harmful white water compounds will be washed out in the last washer stage 30'. By this arrangement, not only is the fresh water consumption and effluent volume maintained at a low level, but in addition, the contamination of the white water and the pulp leaving the dryer, paper making mill, or the like may be reduced up to about 40% of contamination levels currently experienced in the prior art system. Thus, the present invention solves, to a large extent, a potentially damaging and harmful contamination problems presently experienced in the pulp processing industry.

While the invention has been described in what is currently regarded as its most practical embodiment, it will be apparent to those of ordinary skill in the art that many alterations may be made without departing from the spirit and scope of the invention as defined in the claims which follow.

What is claimed is:

1. In a pulp processing system utilizing multiple pulp bleaching and washing stages prior to feeding of said pulp to a further processing device, the method comprising the steps of:
   (a) feeding white water effluent from said further processing device directly to a next-to-last washing stage; and
   (b) reducing contaimination of the pulp and white water effluent leaving the further processing device by feeding fresh water to the last washing stage, causing contamination in the white water effluent fed to the next-to-last washer stage to be reduced at the last washing stage.

2. A method as recited in claim 1 wherein said further processing device comprises a pulp dryer.

3. A method as recited in claim 1, wherein said further processing device comprises a paper making mill.

4. A method as recited in claim 2 wherein step (a) includes the step of feeding filtrate from said last washing stage to said next-to-last washing stage.

5. A method as recited in claim 3 wherein step (a) includes the step of feeding filtrate from said last washing stage to said next-to-last washing stage.

6. A method as recited in claim 2, wherein step (b) includes the step of feeding a minor portion of said white water effluent from said further processing device to said last washing stage.

7. A method as recited in claim 3, wherein step (b) includes the step of feeding a minor portion of said white water effluent from said further processing device to said last washing stage.

8. A method as recited in claim 4, wherein step (b) includes the step of feeding a minor portion of said white water effluent from said further processing device to said last washing stage.

9. A method as recited in claim 1 wherein filtrate from said next-to-last and last washing stages is recycled through preceding stages.

10. In a pulp processing system, the method of reducing contamination in the pulp and in white water effluent discharged from said system, comprising the steps of sequentially:
   (a) feeding pulp from a preceding processing stage to a next-to-last bleaching tower;
   (b) washing the pulp from step (a) in a next-to-last washing device;
   (c) feeding said pulp to a last bleaching tower;
   (d) washing the pulp from step (c) in a last washing device;
   (e) feeding said pulp to a further processing device; and
   (f) during the course of practicing steps (a) through (f), utilizing white water effluent from said further processing device in said next-to-last washing stage, and adding fresh water to said last washing stage so that contamination in the pulp and the white water effluent leaving the further processing device is reduced.

11. The method as recited in claim 10 wherein filtrate from said next-to-last and last washing stages are utilized in preceding bleaching and washing stages.

12. The method as recited in claim 11 wherein filtrate from said last washing stage is utilized in said next-to-last washing stage along with said white water effluent.

13. The method as recited in claim 10 wherein step (e) is practiced by feeding said pulp to a pulp dryer.

14. The method as recited in claim 10 wherein step (e) is practiced by feeding said pulp to a paper making mill.

15. The method as recited in claim 10 wherein step (f) is further practiced by adding to said last washing stage in addition to said fresh water, white water effluent from said further processing device.

16. In a pulp processing system including multiple bleaching and washing stages upstream of a further processing device, which further processing device discharges white water effluent, the improvement comprising:
   (a) means for reducing contamination of said pulp and said white water effluent, said means comprising first conduit means for feeding white water effluent from said further processing device to a next-to-last washing stage, and second conduit means for supplying fresh water to a last washing stage so that contamination of the pulp and white water effluent is reduced at the last washer stage.

17. The pulp processing system as defined in claim 16 wherein said further processing device comprises a pulp dryer.

18. The pulp processing system as defined in claim 16 wherein said further processing device comprises a paper making mill.

19. The pulp processing system as defined in claim 16 and further including conduit means for feeding filtrate from said last washing stage to said next-to-last washing stage.

20. In a pulp processing system including multiple bleaching and washing stages including means for feeding said pulp to a next-to-last bleaching tower, and associated next-to-last washing stage, means for thereafter feeding said pulp to a last bleaching tower and associated last washing stage, means for transporting said pulp from said last washer stage to a pulp dryer, the improvement comprising:

means for feeding white water effluent discharge from said pulp dryer to said next-to-last washer stage; and means for feeding fresh water to said last washer stage to reduce contamination in the pulp and white water effluent leaving the pulp dryer.

* * * * *